United States Patent [19]

Takeda et al.

[11] 4,416,390

[45] Nov. 22, 1983

[54] CLOSURE ARRANGEMENT FOR EASY OPEN TYPE CONTAINER

[75] Inventors: Minoru Takeda; Toshimi Nitta; Hitoshi Saito, all of Iwatsuki, Japan

[73] Assignee: Hokkai Can Co., Ltd., Tokyo, Japan

[21] Appl. No.: 402,334

[22] Filed: Jul. 27, 1982

[30] Foreign Application Priority Data

Jul. 29, 1981 [JP] Japan ..... 56-117671

[51] Int. Cl.[3] ..... B65D 17/34

[52] U.S. Cl. ..... 220/273

[58] Field of Search ..... 220/269, 270, 272, 273

[56] References Cited

U.S. PATENT DOCUMENTS 3,232,474 2/1966 Dunn .
3,428,210 2/1969 Brown .
4,350,262 9/1982 Kaneko ..... 220/273

*Primary Examiner*—George T. Hall

*Attorney, Agent, or Firm*—Birch, Stewart, Kolasch & Birch

[57] ABSTRACT

A closure arrangement adaptable for an easy open type container including a score line wherein a crossing position of the score line portion lying on the longitudinal axis of a pulling tab passing through the center of a rivet is a minimum distant point from the center of the rivet. The score line portion extends from the minimum distant point right and left and projects outwardly in the region between a first subsidiary line crossing at right angles to the longitudinal axis at the minimum distant point and a third subsidiary line passing through the center of the rivet and extending in parallel with the first subsidiary line, so as to form a pair of swelling score line sections on both sides of the rivet. In this manner, the initial opening force can be decreased, and an easy opening closure can be made even if the score residual is made thicker than that in a conventional closure.

7 Claims, 6 Drawing Figures

CLOSURE ARRANGEMENT FOR EASY OPEN TYPE CONTAINER

SUMMARY AND OBJECTS OF THE INVENTION

1. Field of the Invention

This invention relates to a closure arrangement adaptable for an easy open type container, and is more particularly directed to an easy open type closure arrangement having an improved score line form which substantially decreases an opening force required for breaking a tear opening portion surrounded by the score line formed on a closure panel surface.

2. Background of the Invention

Currently, various raw materials such as aluminum thin plate, tin plate, tin free steel plate, and so on are used for forming easy open type closures for cans for beverages such as beer, juice, coffee or the like. Among them, closures made of aluminum plate are used for cans for various kinds of applications because an aluminum closure is easy to open, light in weight and has a pleasing appearance as compared with that of tin plate or tin free steel plate.

Recently, in view of the fact that the raw material price of aluminum is increasing and since the corrosion resisting property of aluminum is inferior with respect to saline contents such as tomato juice or the like, it is desirable to change the closure of aluminum plate to that of tin plate or tin free steel plate. Tin plate and tin free steel are low in price and excellent in the corrosion resisting property.

However, if the can closure is made of a steel plate such as tin plate, tin free steel plate or the like, the same has a toughness peculiar to that material. Accordingly, when the same is to be opened by rupturing the score line formed therein, it requires a larger opening force than that in the case of a can closure made of aluminum. This aspect is unsatisfactory to a user and any improvement to obviate this problem is desirable.

As one measure for solving this problem, a score line on the closure panel may be formed so that a residual is made thinner for improving the opening property thereof. However, in this case, when impressing work is carried out too deeply for forming a thin score residual, a can closure is constructed wherein a crack is liable to be generated in a corner edge of the bottom of the resultant score line. Consequently, there is a danger that when the can is dropped or is given a strong shock, the contents thereof may leak out from the corner edge.

A conventional easy open type can closure arrangement is shown in FIG. 1. Namely, a closure panel surface 1' is impressed by means of a pair of upper and lower dies so that there is formed thereon an endless shape of a score line 2' comprising a pair of comparatively large and small semi-circular portions and a pair of right and left linear portions connected between the two semi-circular portions. The large diametrical semi-circular portion is positioned adjacent to the circumference of the closure panel surface 1', and the small diametrical semi-circular portion surrounds a hollow type rivet 4' formed to project integrally from the closure panel surface 1'. The hollow type rivet 4' is secured, by staking, to a pulling tab 3' having a holding portion 7'. A tear opening portion 5' is defined inside the score line 2'.

With such a configuration of the score line 2', breaking of the tear opening portion 5' is effected by a lever operation of the pulling tab 3'. Namely, the pulling tab 3' is operated in such a manner that a pair of front end portions 6' thereof act as a fulcrum, a rear end portion 7' thereof acts as a point of force and the rivet 4' acts as a point of application. In this operation, in conjunction with lifting the rear end portion 7', the rivet 4' is lifted, and at that time the lifting force is distributed and the distributed and uniform forces thereof are applied to the whole surrounding area of the portion of the score line 2' extending across the longitudinal axis of the pulling tab 3' passing through the center of the rivet 4'. The closure panel surface 1' is deformed until an initial opening or rupturing is made, while a comparatively wide area thereof is being lifted by the lifting force. When the pulling tab 3' is lifted to a position at which the same is inclined about 30 degrees to the horizontal surface as shown in FIG. 3, the semi-circular portion of the score line 2' is broken.

If, for example, the closure panel surface 1' is one made of steel plate such as tin plate, tin free steel plate or the like, the same is comparatively rich in malleability and has a high toughness. Thus, deformation thereof until the initial opening is made becomes harder than that in the case of a closure panel made of aluminum. Naturally, the lifting force required for making the initial opening becomes larger. This produces problems such as, on the one hand, a tab-off phenomenon in that the pulling tab 3' disengages when the rivet 4' before the initial opening is made when the connection by staking between the pulling tab 3' and the rivet 4' is weak or where an irregular opening operation without regularly holding the pulling tab 3' is being carried out. On the other hand, even when a regular opening operation is being carried out, the large lifting force is suddenly changed into a tearing force at the moment when the initial opening has been made because a tension condition of the closure panel caused by the pulling force is suddenly released at that moment. Thereby, the contents of the can may be splashed from the opened portion to soil clothes or the like.

An object of this invention is to provide a closure arrangement for an easy open type container which is free from the foregoing inconveniences with the conventional example and has an improved score line enabling a tear opening portion thereof to be easily broken by a comparatively small initial opening force.

Another object of the invention is to provide a closure arrangement as above wherein the opening property of the tear opening portion is improved and at the same time the score residual can be made thicker than that in the conventional example, and accordingly it becomes possible to prevent the score line from generating a crack at a bottom edge of the score line.

An additional object of this invention is to provide a closure arrangement wherein, owing to the fact that the score residual can be made thicker, the impulsive force of a die to be applied to a closure panel surface on forming the score line thereon may be eased. Thereby, a compensation coating which has been applied, besides a rust-proof base coating, to the rear surface of the score line on the cover panel surface in the conventional example is unnecessary.

A further another object of this invention is to provide a closure arrangement wherein the closure can be easily opened, without making the score residual too thin as in the conventional case, even in the case of using a steel plate such as tin plate or tin free steel plate as the raw material for the closure panel surface.

According to this invention, a closure arrangement is provided having a closure panel surface, a rivet formed to project integrally from the panel surface, a score line defining a tear opening portion including the rivet, a pulling tab secured, by staking, to the rivet and extending in the direction opposite to the tear opening portion, and a front end portion of the pulling tab which acts as a fulcrum for the pulling tab on lifting of a rear end portion of the pulling tab. The invention is characterized in that a position of a point of the score line that lies on the longitudinal axis of the pulling tab passing through the center of the rivet is the minimum distant point from the center of the rivet, and the score line is extended from the minimum distant point to the right side and the left side and so protrudes outwards, between a first subsidiary line crossing at right angles to the longitudinal axis at the minimum distant point. A third subsidiary line passing through the center of the rivet and extending in parallel with the first subsidiary line is provided to form a pair of swelling score line sections on both sides of the rivet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 4:
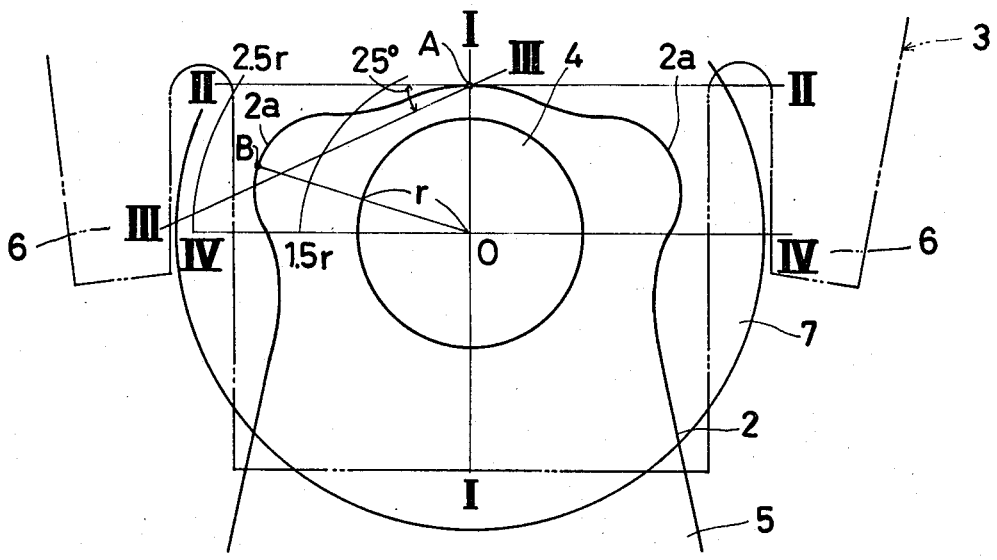
FIG. 4 is an enlarged top plan view of an important portion of the closure of the present invention.
Figure 5:
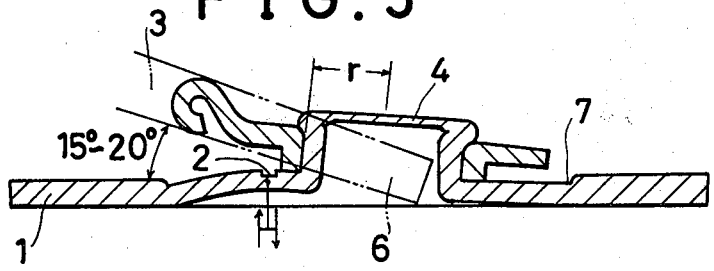
FIG. 5 is a sectional side view showing an initial opening condition of the closure illustrated in FIG. 4.
Figure 6:
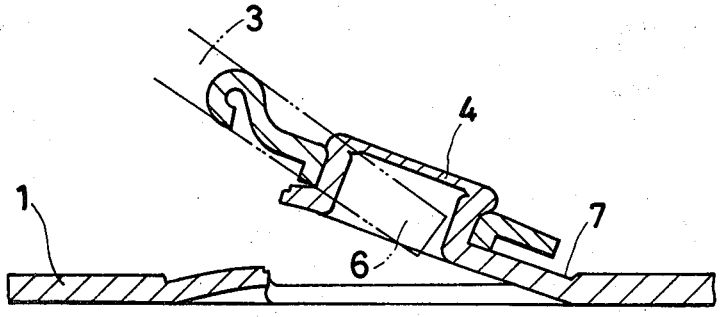
FIG. 6 is a sectional side view showing a broken condition of the closure illustrated in FIG. 5 after the initial opening is effected.

FIGS. 4 to 6 show one embodying example of the present invention applied to a can closure. FIG. 4 is a plan view showing a rivet 4 and an important portion of a score line 2 formed on a closure panel surface 1 made of tin plate. A pulling tab 3, various beads formed on the panel surface 1 and other component parts are substantially equal in construction to those in the conventional example shown in FIG. 1.

The form of the important portion of the score line 2 shown in FIG. 4 will be explained in detail. A point A of the score line 2 lies on a basic axis I—I, which coincides with a longitudinal axis of the pulling tab 3 that passes through a center point O of the rivet 4. The point A is in the closest approximation, among other parts of the score line 2, to the center point O of the rivet 4 so as to constitute the minimum distant point from the center point O. The score line 2 extends symmetrically from the point A to the right side and the left side and is gradually more distant from the center point O of the rivet 4 within an angular region formed between a first subsidiary line II—II crossing at right angles to the basic axis I—I at the minimum distant point A and a second subsidiary line III—III on each side defining an angular range of 25 degrees with respect to the first subsidiary line II—II. The score line 2 protrudes outwardly so as to form a pair of swelling score line sections *2a, 2a* each being within the foregoing angular range of 25 degrees having a maximum distant point B from the center point O of the rivet 4. The score line 2 extends across the second subsidiary line III—III to be gradually closer to the center point O of the rivet 4.

The maximum distant point B is located to lie within the range of 1.5–2.5 times a radius r of the rivet 4. The remainder portion of the score line 2 has an endless semi-circular form substantially the same as that in the conventional example. Thus, there is defined inside the score line 2 a tear opening portion 5 including the rivet 4. A pair of front end portions 6 are provided on the pulling tab 3 adjacent to a coined area 7.

The tear opening portion 5 formed by the score line 2 of this invention may be opened by lifting the rear end portion of the pulling tab 3. When the pulling tab 3 is lifted, a portion of the rivet 4 that is in opposite to the minimum distant point A of the score line 2 portion is lifted to become the highest point. In accordance with the inclination of the rivet 4, the minimum distant point A of the score line 2 that is nearest to the rivet 4 is lifted to the highest level relative to the remaining portions of the score line 2. Also, the score line portion extending towards the swelling score line section *2a* on each side of the rivet 4 gradually becomes distant from the point A and accordingly from the most inclined portion of the rivet 4. Thus, the lifting force caused by the inclination of the rivet 4 becomes gradually weak, accordingly, as the score line portion is nearer to the swelling section *2a*. At the same time, the score line 2 portion is extended from the minimum distant point A right and left which forms into a pair of right and left outwardly swelling sections *2a, 2a,* so that the area of the closure panel surface 1 that is defined between such a score line 2 portion on each side and the periphery of the rivet 4 is restrained from lifting by the score line 2 portion extending between the minimum distant point A and the maximum distant point B on each side. As a result, the lifting force is concentrated on the minimum distant point A.

In the meanwhile, there is generated near the minimum distant point A a shearing force acting between the closure panel surface 1 portion inside the score line 2 and the closure panel surface 1 portion outside the score line 2 as shown in FIG. 5. Consequently, as shown in FIGS. 4 and 5, by the lifting force acting on the minimum distant point A and by the foregoing shearing force, there is caused at and about the point A an initial breaking by a lifiting angle which is smaller than that in the conventional example. For instance, the lifting angle is in an angular range between 15°–20° as shown in FIG. 5, and then the breaking is advanced at a stroke to the maximum distant point B on each side. Thereafter, the remainder portion of the score line 2 is subjected to a tearing force by utilizing a ring of the pulling tab 3, so that the whole score line 2 is easily broken while only the portion of the panel surface 1 near the point A is raised as shown in FIG. 6.

If, it is now assumed that the score line 2 portion extending between the point A and the point B on each side is formed so that a certain part of the score line 2 extends across the second subsidiary line II—II, that is, upwardly thereof in FIG. 4, or that a swelling score line section thereof on each side may lie upwardly of the second subsidiary line II—II, that upwardly protruded part or section of the score line 2 portion on each side lies to the rear of the point A, so that when the point A is lifted, that protruded part thereof is also lifted at the same time, and as a result the initial opening force cannot be decreased. If, it is also assumed that the score line 2 portion extending from the point A to the point B on each side is formed so that the same may extend outside the angular range of the above 25 degrees between the lines II—II and III—III and reach the maximum distant point B lying outside the angular range or that the same may extend once outside the angular range and reach the maximum distant point B lying outside the angular range or that the same may extend once outside the angular range and reach the maximum distant point B within the angular range, this results in a score line 2 portion having the protruded parts extending downwardly in FIG. 4 and passing by the periphery of the rivet 4. This forms a score line portion having not only the point A which is the minimum distant point, but also two minimum distant points on both sides of the rivet 4. Accordingly, when the point A is lifted, it becomes inevitable that the additional two minimum distant points are also lifted at the same time, and consequently the lifting force is distributed.

Accordingly, it is necessary that the score line 2 portion extending from the point A to the point B on each side and the swelling score line section 2*a* on each side lie within the region defined by the line II—II and the line III—III and accordingly the swelling score line section 2*a* of an arc form lies within the region defined by the line II—II and a third subsidiary line IV—IV passing through the center of the rivet 4 and extending in parallel with the line II—II.

Further, it is preferable, on one hand, that the distance of the maximum distant point B from the center of the rivet 4 is below 2.5 times the radius r of the rivet 4. If the distance thereof is larger than the same, the score line range extending from the point A to the point B on each side becomes too wide, so that the initial opening range becomes too large and such an attributed degree of decreasing in the initial opening force that is given by the score line portion is lowered. It is preferable, on the other hand, that the distance of the point B is above 1.5 times the radius r. If the distance is below the same, the range of the score line 2 portion which is to be lifted at the initial opening time is increased to extend from the point A to the whole swelling score line section 2*a*, and the decreasing degree of the initial opening force attributed by the score line portion is also lowered.

Figure 1:
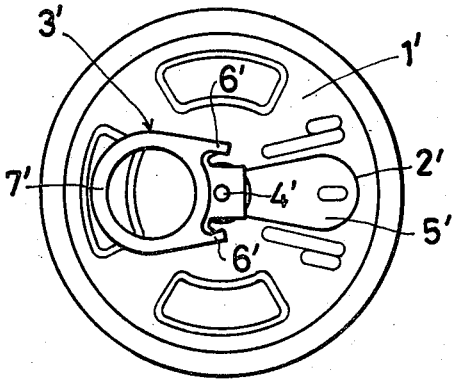
FIG. 1 is a top plan view of a conventional closure.
Figure 2:
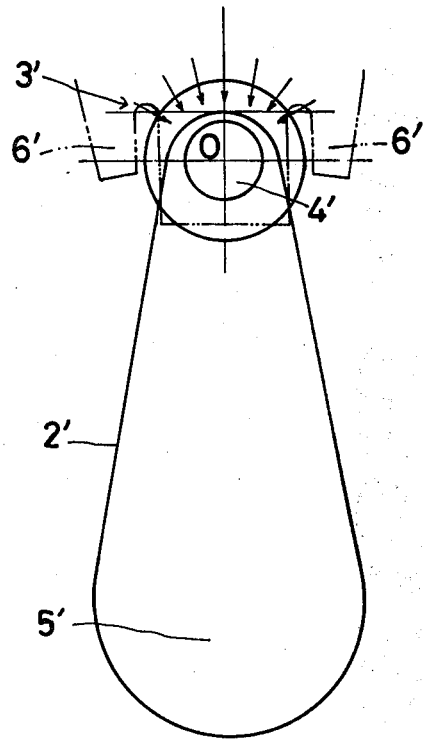
FIG. 2 is an enlarged top plane view of a score line portion as illustrated in FIG. 1.
Figure 3:
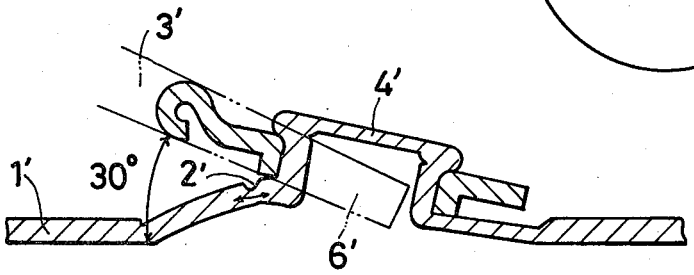
FIG. 3 is a sectional side view showing an initial opening condition of the closure illustrated in FIG. 1.

Some embodying examples of this invention and a conventional example have been compared one with another in the initial opening force (pop value) to obtain Table 1. The form of the score line 2' in the conventional example is as shown in FIGS. 1 and 2, and the other constructions of the closure are substantially the same in all the examples.

TABLE 1

| | Conventional example | Embodying example I | Embodying example II |
|---|---|---|---|
| Material of closure panel surface | Tin plate | Tin plate | Tin plate |
| Average value of plate thickness | 0.239 mm | 0.236 mm | 0.237 mm |
| Average value of score residual | 0.065 mm | 0.069 mm | 0.070 mm |
| Average value of coin residual | 0.161 mm | 0.157 mm | 0.162 mm |
| Rivet radius* | 1.65 mm | 1.65 mm | 1.65 mm |
| Distance of point A from rivet center | 2.11 mm | 2.11 mm | 2.11 mm |
| Distance of point B from rivet center | 2.11 mm | 3.20 mm | 3.20 mm |
| Number of test samples | 30 pieces | 30 pieces | 30 pieces |
| Average pop value | 1.97 kg | 1.13 kg | 1.30 kg |
| Maximum pop value | 1.99 kg | 1.22 kg | 1.36 kg |
| Minimum pop value | 1.81 kg | 1.04 kg | 1.18 kg |

*The rivet radius shows ½ of an outer diameter of the tubular side wall of the rivet.

As clear from the result of Table 1, even when the score residual in each of the embodying examples I, II is made larger than that in the conventional example, the top value becomes smaller.

Thus, according to this invention, the crossing position of the score line portion lying on the longitudinal axis of the pulling tab passing through the center of the rivet is the minimum distant point from the center of the rivet, and the score line portion is extended from the point right and left and projects outwardly in the region between the first subsidiary line crossing at right angles to the longitudinal axis at the minimum distant point and the third subsidiary line passing through the center of the rivet and extending in parallel with the first subsidiary line, so as to form a pair of swelling score line sections on both outsides of the rivet. In this manner, the initial opening force can be decreased, and an easy opening can be made even if the score residual is made thicker than that in the conventional example. As a result, on forming of the score line, an impulsive force can be eased and there is no generation of a crack at a corner edge of the bottom of the score line of the closure panel. Also a compensation coating, in addition to rust-proof base coating, which has been applied to the under surface of the score line of the closure panel surface in the conventional example is unnecessary and consequently the manufacturing cost can be lowered. This results in the production of an easy open closure arrangement suitable for a container of tin plate or tin free plate.

We claim:

1. A closure arrangement for an easy open type container comprising:

a closure panel surface;

a rivet formed to project integrally from the panel surface;

a score line defining a tear opening portion including the rivet therein;

a pulling tab secured, by staking, to the rivet and extending in a direction opposite to the tear opening portion;

said pull tab including a front end portion serving as a fulcrum for the pulling tab on lifting a rear end portion of the pulling tab;

said score line including a point lying on a longitudinal axis of the pulling tab passing through the center of the rivet, said point being a minimum distant point from the center of the rivet, and said score line extending from the minimum distant point to the right side and the left side to project outwardly between a first subsidiary line crossing at right angles to the longitudinal axis at the minimum distant point and a third subsidiary line passing through the center of the rivet and extending in parallel with the first subsidiary line to form a pair of swelling score line sections on both sides of the rivet.

2. A closure arrangement according to claim 1, wherein the score line extends from the minimum distant point to the right side and the left side within an angular range of 25 degrees formed between the first subsidiary line and a second subsidiary line, and a maximum distant point from the center of the rivet on each of the pair of swelling score line sections is located within the angular range of 25 degrees, and the distance of the maximum distant point from the center of the rivet is 1.5–2.5 times a radius of the rivet.

3. A closure arrangement according to claim 1, wherein a lifting angle in the range of 15–20 degrees is sufficient to break said score line.

4. A closure arrangement according to claim 1, wherein said closure panel is constructed of tin plate.

5. A closure arrangement according to claim 1, wherein said closure panel is constructed of tin free steel plate.

6. A closure arrangement according to claim 1, wherein said minimum distant point initially forms the highest point of said score line as said lifting tab is raised above said closure panel surface.

7. A closure arrangement according to claim 6, wherein after said minimum distant point on said score line is severed the score line is broken outwardly towards a maximum distant point disposed within an angular range of 25 degrees between said first subsidiary line and a second subsidiary line.

* * * * *